US010944160B2

(12) United States Patent
Wang et al.

(10) Patent No.: US 10,944,160 B2
(45) Date of Patent: Mar. 9, 2021

(54) ELECTRONIC DEVICE

(71) Applicant: Lenovo (Beijing) Co., Ltd., Beijing (CN)

(72) Inventors: Wenlei Wang, Beijing (CN); Dafei Mo, Beijing (CN); Weimin Bao, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 16/453,011

(22) Filed: Jun. 26, 2019

(65) Prior Publication Data

US 2019/0393592 A1 Dec. 26, 2019

(30) Foreign Application Priority Data

Jun. 26, 2018 (CN) ..... 201810672604.9

(51) Int. Cl.
*H01Q 1/24* (2006.01)
*H01Q 1/36* (2006.01)
*H01Q 1/22* (2006.01)

(52) U.S. Cl.
CPC ..... *H01Q 1/36* (2013.01); *H01Q 1/22* (2013.01)

(58) Field of Classification Search
CPC .. H01Q 1/36; H01Q 1/22; H01Q 9/42; H01Q 1/44; H01Q 1/2266; H01Q 1/50
See application file for complete search history.

(56) References Cited

U.S. PATENT DOCUMENTS

| | | | | |
|---|---|---|---|---|
| 9,484,618 | B2 * | 11/2016 | Sarapin | C08F 10/06 |
| 2013/0050050 | A1 * | 2/2013 | Zhu | H01Q 1/2291 343/866 |
| 2013/0321216 | A1 | 12/2013 | Jervis et al. | |
| 2015/0244059 | A1 * | 8/2015 | Onaka | H01Q 21/28 343/702 |
| 2015/0255851 | A1 | 9/2015 | Guterman et al. | |

FOREIGN PATENT DOCUMENTS

| | | | |
|---|---|---|---|
| CN | 1937313 | A | 3/2007 |
| CN | 101232527 | A | 7/2008 |
| CN | 101911379 | A | 12/2010 |
| CN | 103163941 | A | 6/2013 |
| CN | 205122774 | U | 3/2016 |

* cited by examiner

*Primary Examiner* — Dieu Hien T Duong
(74) *Attorney, Agent, or Firm* — Anova Law Group, PLLC

(57) ABSTRACT

An electronic device is provided. The electronic device includes: a first tubular structure having an annular cross-section and including a conductive first tubular member at a first end of the first tubular structure and a conductive second tubular member at a second end of the first tubular structure; an insulating spacer disposed between the first tubular member and the second tubular member; an insulating slot disposed on a sidewall of the second tubular member and extending through the sidewall along a direction the first tubular structure extends; and a first feed point disposed on the second tubular member, the second tubular member transmitting a signal received from the first feed point.

13 Claims, 4 Drawing Sheets

ELECTRONIC DEVICE

CROSS-REFERENCES TO RELATED APPLICATIONS

This application claims the priority of Chinese Patent Application No. 201810672604.9, filed on Jun. 26, 2018, the entire content of which is incorporated herein by reference.

FIELD OF THE DISCLOSURE

The present disclosure generally relates to the field of electronics technology and, more particularly, relates to an electronic device.

BACKGROUND

With the development of technologies, more and more electronic devices include an integrated antenna function. However, in the existing electronic devices, an antenna radiator is often disposed on a main board of an electronic device. This type of antenna configuration lacks flexibility.

The disclosed electronic device is directed to solve one or more problems set forth above and other problems in the art.

BRIEF SUMMARY OF THE DISCLOSURE

One aspect of the present disclosure provides an electronic device. The electronic device includes a first tubular structure having an annular cross-section and including a conductive first tubular member at a first end of the first tubular structure and a conductive second tubular member at a second end of the first tubular structure; an insulating spacer disposed between the first tubular member and the second tubular member; an insulating slot disposed on a sidewall of the second tubular member and extending through the sidewall along a direction the first tubular structure extends; and a first feed point disposed on the second tubular member, the second tubular member transmitting a signal received from the first feed point.

Another aspect of the present disclosure provides another electronic device. The electronic device includes a first tubular structure having an annular cross-section and including a conductive first tubular member at a first end of the first tubular structure and a conductive second tubular member at a second end of the first tubular structure; a first insulating spacer disposed between the first tubular member and the second tubular member; a first insulating slot disposed on a sidewall of the second tubular member and extending through the sidewall along the direction the first tubular structure extends; and a first feed point disposed on the second tubular member, the second tubular member transmitting a signal received from the first feed point. Further, the electronic device includes a second tubular structure having an annular cross-section and including a conductive third tubular member at a first end of the second tubular structure and a conductive fourth tubular member at a second end of the second tubular structure; a second insulating spacer disposed between the third tubular member and the fourth tubular member; a second insulating slot disposed on a sidewall of the fourth tubular member and extending through the sidewall along a direction that the second tubular structure extends; and a second feed point disposed on the fourth tubular member, the fourth tubular member transmitting a signal received from the second feed point.

Other aspects of the present disclosure can be understood by those skilled in the art in light of the description, the claims, and the drawings of the present disclosure.

BRIEF DESCRIPTION OF THE DRAWINGS

To more clearly illustrate the technical solution in the present disclosure, the accompanying drawings used in the description of the disclosed embodiments are briefly described hereinafter. The drawings described below are merely some embodiments of the present disclosure. Other drawings may be derived from such drawings by a person with ordinary skill in the art without creative efforts and may be encompassed in the present disclosure.

DETAILED DESCRIPTION

To make the foregoing objectives, features and advantages of the present disclosure clearer and more understandable, the present disclosure will be further described with reference to the accompanying drawings and embodiments. However, exemplary embodiments may be embodied in various forms and should not be construed as limited to the embodiments set forth herein. Rather, these embodiments are provided to fully convey the thorough and complete concepts of the exemplary embodiments to those skilled in the art.

Figure 1:
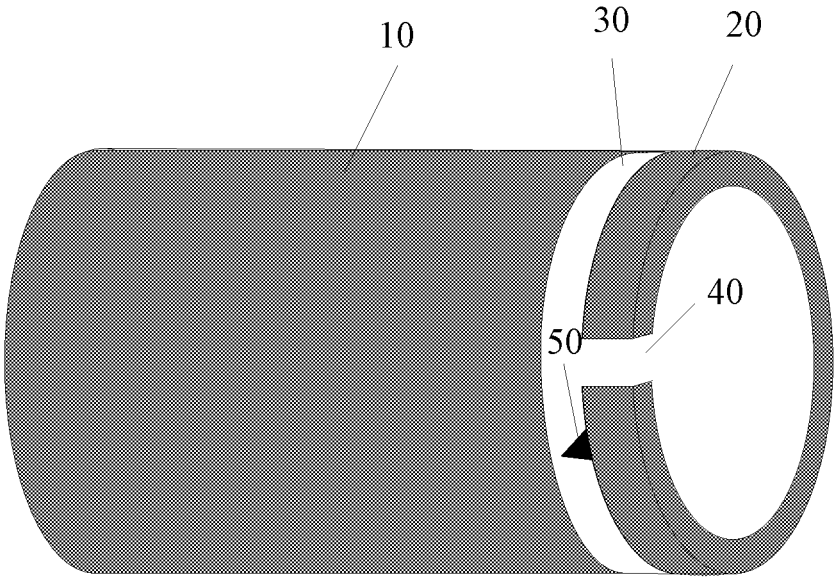
FIG. 1 illustrates a schematic view of an example of a first tubular structure in an electronic device according to some embodiments of the present disclosure.

The present disclosure provides an electronic device. As shown in FIG. 1, the electronic device includes a first tubular structure having an annular cross-section. The first tubular structure includes a conductive first tubular member 10 at a first end of the first tubular structure and a conductive second tubular member 20 at a second end of the first tubular structure. The first end and the second end are opposite to each other.

The first tubular member 10 and the second tubular member 20 are insulated by an insulating spacer 30 in between. An insulating slot 40 is disposed on a sidewall of the second tubular member 20 and extends through the entire sidewall in a direction that the first tubular structure extends. The second tubular member 20 includes a first feed point 50 and at least receives an antenna signal from the first feed point 50 to transmit the antenna signal outwardly.

In one embodiment, the annular cross-section only indicates that the first tubular structure is a hollow structure and is not intended to limit shapes of the cross-section of the first tubular structure. The cross-section of the first tubular structure may have a circular ring shape, an elliptical ring shape, a rectangular ring shape, and other regular or irregular ring shapes. The present disclosure does not limit the shapes of the cross-section.

In one embodiment, the cross-section of the first tubular structure includes an inner ring and an outer ring. The inner ring and the outer ring may have a same shape or different shapes. The inner ring or the outer ring may have a same size or different sizes at different positions of the first tubular structure. The present disclosure does not limit the sizes of the inner ring and the outer ring.

In one embodiment, the first tubular structure is made of a metallic material. That is, the first tubular member 10 is a metallic tube-shaped member and the second tubular member 20 is also a metallic tube-shaped member, thereby improving antenna performance in the electronic device. In response to an all-metal casing of the electronic device, a metal proportion in the electronic device increases, a consistency of an overall appearance of the electronic device improves, and the electronic device appears more elegant.

With the development of the electronic technology, the electronic device is widely used. In addition to people's daily use, the electronic device may often be used in a harsh environment, such as under an extreme temperature. In one embodiment, the electronic device may be configured in an aerospace propeller (e.g., a satellite launcher, a rocket, etc.) During a process of leaving or re-entering the Earth's atmosphere, the aerospace propeller may be under the extreme temperature due to fuel burning or atmosphere friction. In response to the extreme temperature exceeding a metal melting temperature, the first tubular structure may be damaged or melted and the antenna function may not be achieved. The electronic device may be configured in other part of an aerospace apparatus. In response to the extreme temperature, the electronic device may be unable to support the antenna function.

Similarly, in one embodiment, the electronic device may be configured in an automobile. In response to starting up the automobile, cruising at a high speed, or driving for a substantially long period, the electronic device may be under the extreme temperature. In another embodiment, the electronic device may be configured in a probing apparatus deployed in a live volcano or deeply underground. The probing apparatus may be under the extreme temperature. In response to the extreme temperature exceeding the metal melting temperature, the first tubular structure (or the second tubular member) may be damaged or melted and may be unable to support the antenna function.

Conductive ceramic is a material that is conductive at a temperature higher than 1,000° C. In one embodiment, the first tubular structure is made of a conductive ceramic material. As such, the electronic device may be deployed under the extreme temperature and may be able to support the antenna function under the harsh environment.

In one embodiment, the first tubular structure may be entirely made of a conductive material. In another embodiment, a portion of the first tubular structure may be made of the conductive material and the remaining portion of the first tubular structure may be made of a non-conductive material. In another embodiment, a section of the first tubular structure may be made of the conductive material and the remaining first tubular structure may be made of the non-conductive material. The present disclosure does not limit material composition of the first tubular structure as long as the second tubular member in the first tubular structure is able to function as the antenna radiator.

In one embodiment, the first tubular structure includes an insulating casing and conductive components filled inside the insulating casing. Preferably, the insulating casing is a tubular casing. That is, the insulating casing includes a first tubular surface and a second tubular surface, and a tubular gap is formed between the first tubular surface and the second tubular surface. The tubular gap is filled with the conductive components. However, this is only one example of the first tubular structure implementations. The present disclosure does not limit implementations of the first tubular structure.

In one embodiment, the conductive components may be rigid conductive components, such as metallic components or may be flexible conductive components, such as graphite components. The present disclosure does not limit materials of the conductive components.

In one embodiment, the first tubular structure may be a straight tube. In another embodiment, the first tubular structure may be a ring-shaped tube. In other embodiments, the first tubular structure may be an L-shaped tube, a U-shaped tube, or an S-shaped tube, each having the annular cross-section. The present disclosure does not limit shapes of the first tubular structure as long as the first tubular structure has the annular cross-section and at least two free ends for facilitating the first tubular member and the second tubular member.

In one embodiment, the second tubular member 20 is configured only to transmit outwardly the antenna signal received from the first feed point 50. In another embodiment, the second tubular member 20 is configured not only to transmit outwardly the antenna signal received from the first feed point 50, but also to receive the antenna signal transmitted from the outside to the electronic device. The present disclosure does not limit functions of the second tubular member 20.

In one embodiment, an extension direction of the first tubular structure may be in parallel to a central axis of the first tubular structure or may form an angle between 0° and 90° with respect to the central axis of the first tubular structure. The present disclosure does not limit the extension direction of the first tubular structure as long as the insulating slot 40 disposed on the sidewall of the second tubular member 20 extends through the entire sidewall in the extension direction of the first tubular structure. In one embodiment, the extension direction of the first tubular structure is in parallel to the central axis of the first tubular structure, that is, forming a 0° angle with respect to the central axis of the first tubular structure.

In one embodiment, the insulating spacer 30 and the insulating slot 40 are connected. The insulating spacer 30 has an annular shape. The annular-shaped insulating spacer 30 may be a circular insulating spacer, an elliptical insulating spacer, a rectangular insulating spacer, or other irregular shape insulating spacer. The shape of the insulating spacer 30 depends on the shape of the first tubular structure. The insulating slot 40 may be a straight-line slot, a curved-line slot, a bent-line slot, or an S-line slot. The present disclosure does not limit the shape of the insulating slot 40 as long as the insulating slot 40 extends through the entire sidewall of the second tubular member 20 in the extension direction of the first tubular structure.

In one embodiment, the insulating spacer 30 and the insulating slot 40 may satisfy a preset perpendicular condition to reduce fabrication complexity of the insulating slot 40. The preset perpendicular condition satisfied by the insulating spacer 30 and the insulating slot 40 may include satisfying the preset perpendicular condition between the insulating slot 40 and a plane where the insulating spacer 30 is located. The preset perpendicular condition includes that, within a tolerance range, the insulating slot 40 is perpendicular to the plane where the insulating spacer 30 is located.

For example, in response to the annular cross-section of the first tubular structure, the preset perpendicular condition satisfied by the insulating spacer 30 and the insulating slot 40 may include the following options. The plane where the insulating spacer 30 is located is perpendicular to the central axis of the first tubular structure and the insulating slot 40 is in parallel to the central axis of the first tubular structure. The plane where the insulating spacer 30 is located is approximately perpendicular to the central axis of the first tubular structure and the insulating slot 40 is in parallel to the central axis of the first tubular structure. The plane where the insulating spacer 30 is located is perpendicular to the central axis of the first tubular structure and the insulating slot 40 is approximately in parallel to the central axis of the first tubular structure. The plane where the insulating spacer 30 is located is approximately perpendicular to the central axis of the first tubular structure and the insulating slot 40 is approximately in parallel to the central axis of the first tubular structure. The present disclosure does not limit the options of the preset perpendicular condition.

In one embodiment, the tolerance range may be within about 2°, 5°, 10°, or other angles. The present disclosure does not limit angles of the tolerance range.

In one embodiment, the insulating spacer 30 is an air spacer. The insulating slot 40 is an air slot. That is, the insulating spacer 30 and the insulating slot 40 are filled with air. As such, the structure of the electronic device is simplified, and the cost of the electronic device is lowered. In one embodiment, the electronic device further includes a first insulating member disposed in the insulating spacer 30 and a second insulating member disposed in the insulating slot 40. That is, the first insulating member fills the insulating spacer 30 and the second insulating member 40 fills the insulating slot 40. Thus, the overall integrity of the first tubular structure is improved, and the appearance looks more elegant.

In one embodiment, the first insulating member and the second insulating member may be separately formed or may be integrally formed to streamline a fabrication process of the first tubular structure. The first insulating member and the second insulating member may facilitate a fixed electrical connection between the first tubular member and the second tubular member. The present disclosure does not limit the function of the first insulating member and the second insulating member.

In one embodiment, both the first insulating member and the second insulating member are a plastic member to reduce the fabrication complexity and cost of the first insulating member and the second insulating member. The present disclosure does not limit materials of the first insulating member and the second insulating member.

In the embodiments of the present disclosure, the electronic device transmits outwardly the antenna signal received from the first feed point 50 through the second tubular member 20 of the first tubular structure. That is, the second tubular member 20 functions as the antenna radiator of the electronic device. As such, the limitation of configuring the antenna radiator only on the main board in the existing electronic device may be eliminated, and the problem of limited antenna configurations in the existing electronic device may be resolved, thereby satisfying the demand for flexible antenna configurations in the electronic device.

Figure 2:
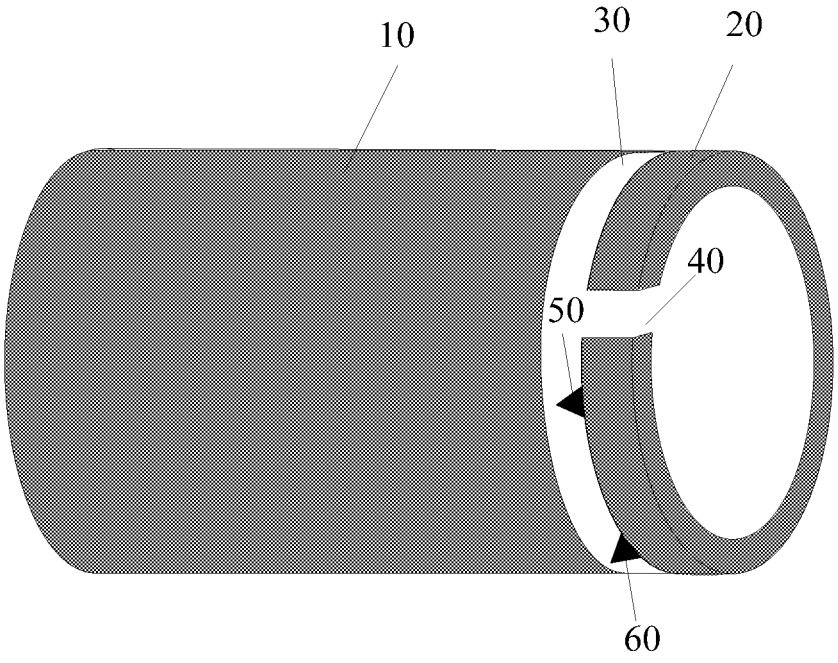
FIG. 2 illustrates a schematic view of another example of the first tubular structure in the electronic device according to some embodiments of the present disclosure.

In one embodiment, as shown in FIG. 2, the second tubular member 20 includes a first grounding point 60. The electronic device further includes a second grounding point. The first grounding point 60 is electrically connected to the second grounding point through the first tubular member 10. For example, the first grounding point 60 is electrically connected to the first tubular member 10, and the first tubular member 10 is electrically connected to the second grounding point.

In one embodiment, the first grounding point 60 is electrically connected to the first tubular member 10 through a conductive connecting component to simplify the structure of the electronic device. The conductive connecting component may be a conductive spring or other electrical connection components to provide the electrical connection.

In one embodiment, the first grounding point 60 is electrically connected to the first tubular member 10 through an adaptor circuit. The adaptor circuit is configured to adjust a resonant frequency of the antenna of the electronic device, thereby improving the antenna performance in the electronic device.

In one embodiment, the adaptor circuit may include capacitors only, inductors only, or both capacitors and inductors. The present disclosure does not limit components of the adaptor circuit.

In one embodiment, the electronic device further includes a signal source. The first feed point 50 is electrically connected to the signal source. For example, the first feed point 50 is electrically connected to the signal source of the electronic device through an inner conductor of a feeder coaxial cable. The first tubular member 10 is electrically connected to the second grounding point of the electronic device through an outer conductor of the feeder coaxial cable. An insulating layer is configured between the inner conductor and the outer conductor of the feeder coaxial cable. Thus, through a single feeder coaxial cable in the electronic device, the first feed point 50 is electrically connected to the signal source and the first tubular member 10 is electrically connected to the second grounding point.

In one embodiment, the electronic device further includes a circuit board. The signal source and the second grounding point are configured on the circuit board. However, the present disclosure does not limit configurations of the signal source and the second grounding point.

Figure 3:
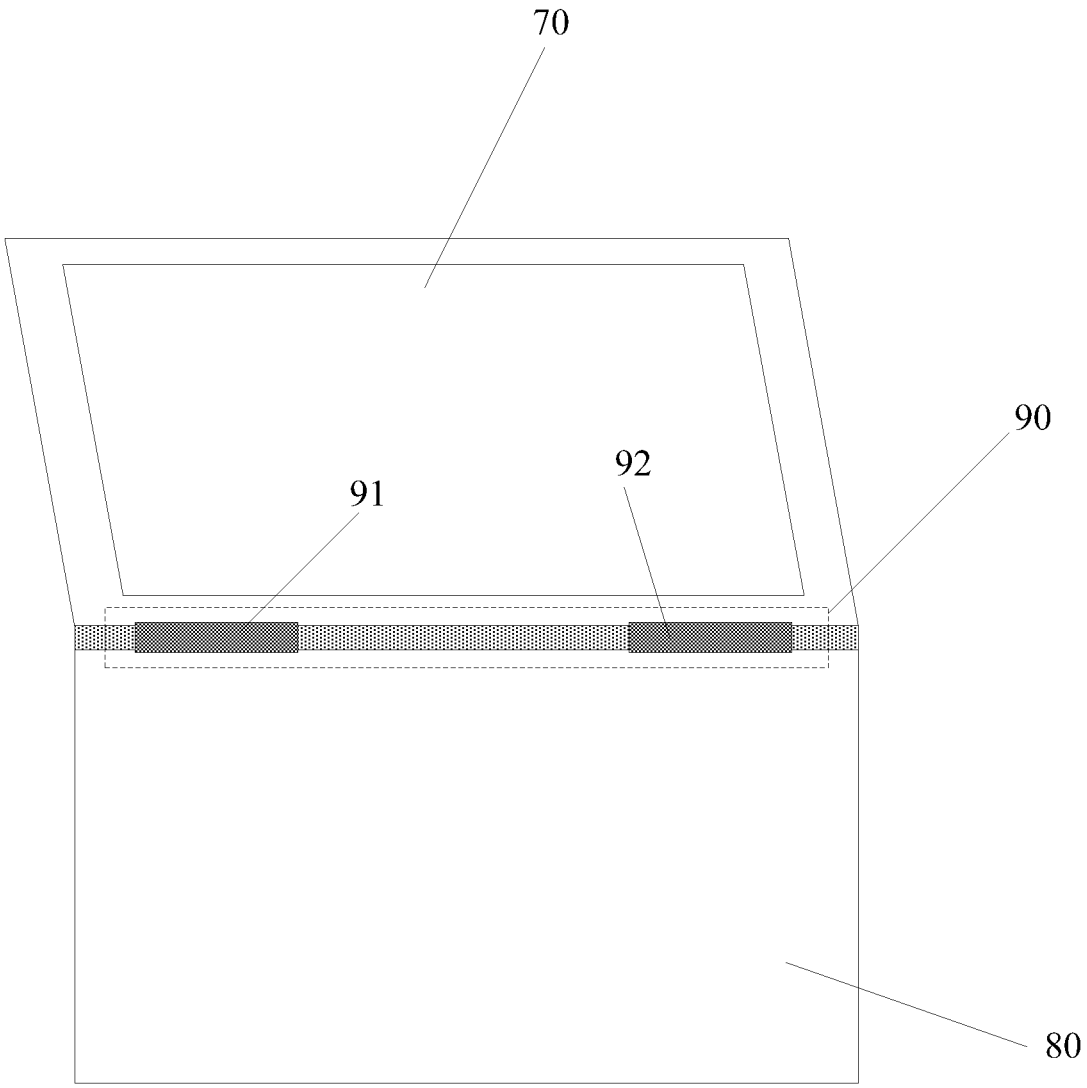
FIG. 3 illustrates a schematic view of an example of the electronic device according to some embodiments of the present disclosure.

In one embodiment, as shown in FIG. 3, the electronic device further includes a first body 70, a second body 80, and a rotating shaft system 90 that connects the first body 70 and the second body 80 together. The rotating shaft system 90 facilitates the first body 70 to rotate relative to the second body 80.

In one embodiment, the electronic device may be a notebook computer, an all-in-one computer or a tablet computer having a rotating bracket. The electronic device may be other electronic devices such as a smart door having the antenna function. The present disclosure does not limit types of the electronic device as long as the electronic device includes the first body, the second body that rotates relative to the first body, and the antenna function. For illustrative purposes, the notebook computer will be used as an example to describe the electronic device.

In one embodiment, the electronic device is the notebook computer. The first body 70 is a body having a display screen. The second body 80 is a body having a keyboard. In another embodiment, the first body 70 is the body having the keyboard. The second body 80 is the body having the display screen. The present disclosure does not limit configurations of the first body 70 and the second body 80.

With the development of a touch-control technology, more and more electronic devices include an integrated touch-control function. In one embodiment, the body having the keyboard may be a body having a touch-control keyboard or a body having a physical keyboard. In another embodiment, the body having the display screen may be a body having a touch-control display screen or a body having a display screen without the touch-control function. In another embodiment, the body having the keyboard may be the body having the touch-control keyboard or the body having the physical keyboard, and the body having the display screen may be the body having the touch-control display screen or the body having the display screen without the touch-control function. The present disclosure does not limit configurations of the body having the keyboard and the body having the display screen.

With the development of the electronic technology, the electronic device with an all-metal casing is favored by more and more users due to beautiful appearance and desirable surface texture thereof and is gradually dominating appearance designs of the electronic device. However, the all-metal casing may shield the antenna radiator of the electronic device. Thus, a bandwidth of the antenna may be narrowed, the antenna performance may be deteriorated, and requirements for the antenna performance may not be satisfied.

The antenna may be configured in the rotating shaft system of the electronic device and a casing of the rotating shaft system may be made of a plastic material to widen the bandwidth of the antenna and to improve the antenna performance. However, configuring the antenna in the rotating shaft system may increase a size of the rotating shaft system. Thus, an overall thickness of the electronic device may increase, thereby contradicting a development trend of ultra-thin electronic devices.

Further, the casing of the rotating shaft system may be configured to become the antenna of the electronic device. As such, the shielding of the antenna by the all-metal casing may be avoided, the size of the rotating shaft system may not increase, and the overall thickness of the electronic device may not increase, thereby catering to the development trend of the ultra-thin electronic devices.

In one embodiment, the first tubular structure may include at least a portion of the rotating shaft system of the electronic device. At least a portion of the rotating shaft system is located inside the first tubular member 10 and does not extend into the second tubular member 20 to avoid interference with a radiating performance of the second tubular member 20 or degradation of the antenna performance of the electronic device.

Figure 4:
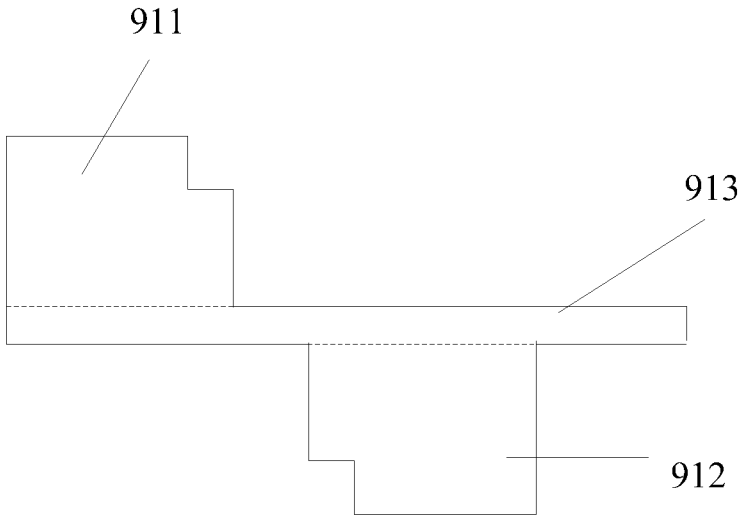
FIG. 4 illustrates a schematic view of an example of a rotating shaft system in the electronic device according to some embodiments of the present disclosure.
Figure 5:
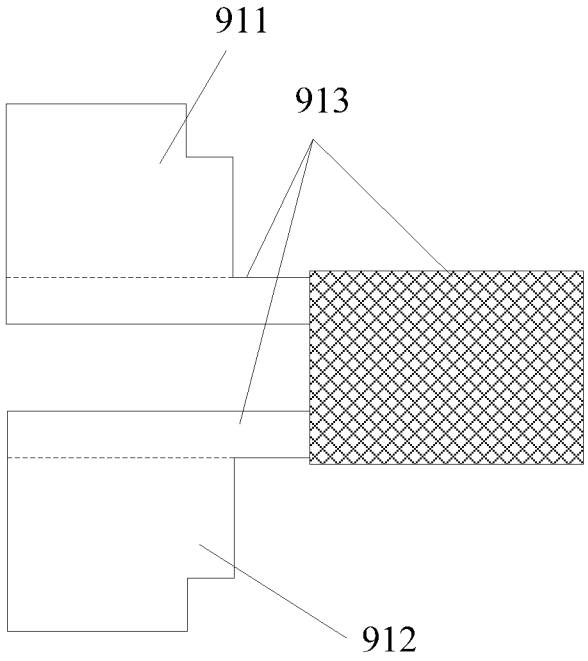
FIG. 5 illustrates a schematic view of another example of the rotating shaft system in the electronic device according to some embodiments of the present disclosure.

In one embodiment, as shown in FIG. 3, the rotating shaft system 90 includes a first rotating shaft assembly 91 and a second rotating shaft assembly 92. As shown in FIG. 4 and FIG. 5, the first rotating shaft assembly 91 includes a first fixing member 911 fixedly coupled to the first body 70, a second fixing member 912 fixedly coupled to the second body 80, and a first rotating shaft structure 913 rotationally coupled to the first fixing member 911 and the second fixing member 912. The second rotating shaft assembly 92 includes a third fixing member fixedly coupled to the first body 70, a fourth fixing member fixedly coupled to the second body 80, and a second rotating shaft structure rotationally coupled to the third fixing member and the fourth fixing member.

Figure 6:
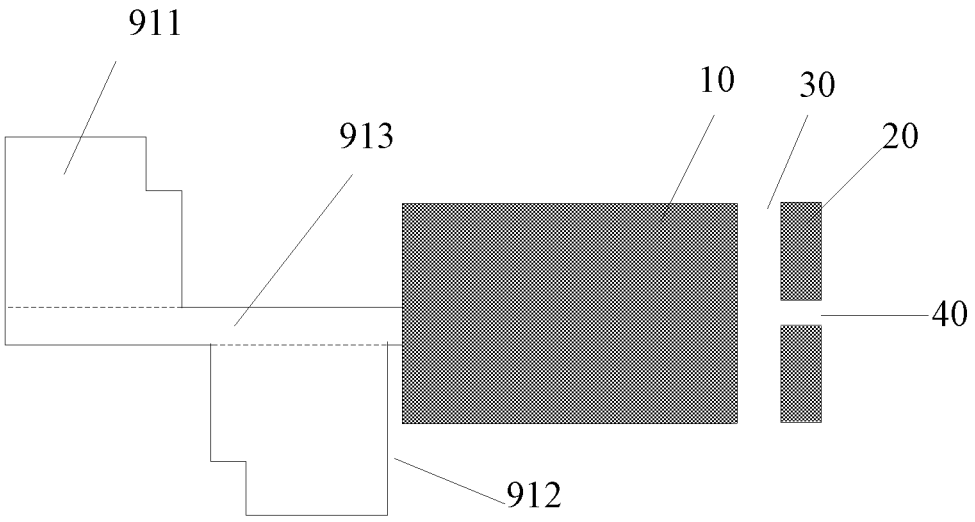
FIG. 6 illustrates a schematic view of relative positions between the first tubular structure and a first rotating shaft structure in the electronic device according to some embodiments of the present disclosure.
Figure 7:
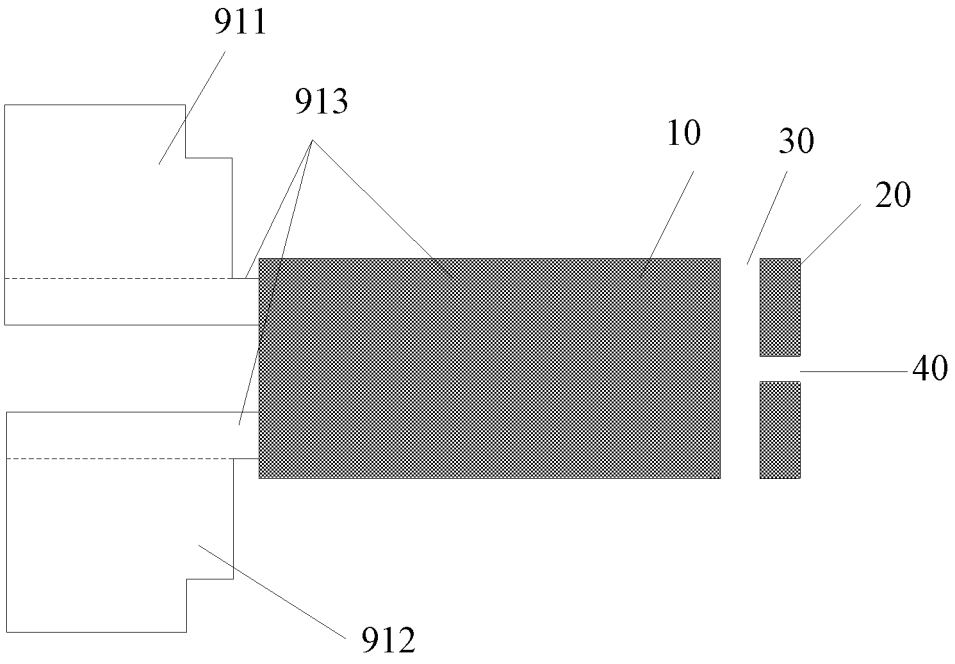
FIG. 7 illustrates a schematic view of relative positions between the first tubular structure and the first rotating shaft structure in the electronic device according to some embodiments of the present disclosure.

In one embodiment, as shown in FIG. 6 and FIG. 7, at least a portion of the first rotating shaft structure 913 is located inside the first tubular member 10 and does not extend into the second tubular member 20 to avoid interference with the radiating performance of the second tubular member 20 or degradation of the antenna performance of the electronic device. In one embodiment, the first rotating shaft structure 913 is electrically connected to the first tubular member 10, such that the first rotating shaft structure 913 becomes a part of an antenna structure of the electronic device, thereby reducing the degradation of the antenna performance of the electronic device caused by the first rotating shaft structure 913.

In one embodiment, at least a portion of the second rotating shaft structure is located inside the first tubular member 10 and does not extend into the second tubular member 20 to avoid interference with the radiating performance of the second tubular member 20 or degradation of the antenna performance of the electronic device. In one embodiment, the second rotating shaft structure is electrically connected to the first tubular member 10, such that the second rotating shaft structure becomes a part of the antenna structure of the electronic device, thereby reducing the degradation of the antenna performance of the electronic device caused by the second rotating shaft structure.

In one embodiment, the first tubular structure is made of the metallic material. That is, the first tubular member 10 is a metallic tubular member, and the second tubular member 20 is another metallic tubular member. As such, on the basis that protection of the rotating shaft system by the first tubular structure is ensured, the antenna performance of the electronic device is improved. In response to the all-metal casing of the electronic device, the casing of the rotating shaft system is also made of the metallic material. Thus, the metal proportion in the electronic device increases, the consistency of the overall appearance of the electronic device improves, and the electronic device appears more elegant.

In response to a long rotating shaft in the rotating shaft system of the electronic device, it is difficult or unable to fabricate a plastic casing. Thus, in the electronic device provided by the present disclosure, the first tubular structure is made of the metallic material. The rotating shaft of the rotating shaft system of the electronic device may be made having a substantial length, thereby a design of the overall appearance of the electronic device is more flexible. However, the present disclosure does not limit the length of the rotating shaft as long as the first tubular structure is made of a rigid and conductive material to protect the rotating shaft system and to achieve the antenna performance.

In one embodiment, the first tubular structure is made of a conductive ceramic material. In another embodiment, the first tubular structure includes an insulating casing filled with graphite. The insulating casing protects the rotating shaft system and the graphite inside the insulating casing achieves the antenna performance. Preferably, the insulating casing has an annular shape, that is, including a first tubular surface and a second tubular surface that are nested. An annular gap may be formed between the first tubular surface and the second tubular surface and may be filled with the graphite. However, this is only one of many implementations of the first tubular structure. The present disclosure does not limit implementations of the first tubular structure.

In the electronic device provided by the present disclosure, the antenna signal received from the first feed point may be transmitted outwardly through the second tubular member 20 in the first tubular structure. That is, the second tubular member 20 functions as the antenna radiator of the electronic device. As such, the antenna of the electronic device is configured on the casing of the rotating shaft system of the electronic device and is no longer configured inside the rotating shaft system. On the basis that the antenna of the electronic device achieves the desirable antenna performance, the size of the rotating shaft system does not increase, thereby catering to the development trend of the ultra-thin electronic devices.

Moreover, in the electronic device provided by the present disclosure, the casing of the rotating shaft system forms the antenna structure without the need for the separately fabricated antenna radiator. As such, the cost of the electronic device is reduced. In response to the all-metal casing of the electronic device, the electronic device satisfies the requirements of the antenna performance without cutting any slot or slit on the casing of the electronic device. Thus, the appearance of the electronic device is more beautiful and the integrity of the appearance of the electronic device is preserved.

In addition, in the electronic device provided by the present disclosure, the first tubular structure is a metallic tubular structure. That is, the casing of the rotating shaft system of the electronic device is made of the metallic material. Thus, the metal proportion in the electronic device increases, the consistency of the overall appearance of the electronic device improves, and the electronic device appears more elegant.

In one embodiment, the electronic device may include only one antenna or a plurality of antennas, that is, two or more antennas. The present disclosure does not limit the number of the antennas. For illustrative purposes, the electronic device including the two antennas is described.

In one embodiment, in response to a plurality of antennas in the electronic device, the electronic device further includes a second tubular structure having the annular shape cross-section. The second tubular structure includes a conductive third tubular member at a first end of the second tubular structure and a conductive fourth tubular member at a second end of the second tubular structure. The first end and the second end are opposite to each other. An insulating gap is formed between the third tubular member and the fourth tubular member. An insulating slot may be cut on a sidewall of the fourth tubular member and extends through the entire sidewall of the fourth tubular member in a direction that the second tubular structure extends. The fourth tubular member includes a second feed point and transmits outwardly at least an antenna signal received from the second feed point.

In one embodiment, the fourth tubular member is configured only to transmit outwardly the antenna signal received from the second feed point. In another embodiment, the fourth tubular member is configured not only to transmit outwardly the antenna signal received from the second feed point, but also to receive the antenna signal transmitted from the outside to the electronic device. The present disclosure does not limit functions of the fourth tubular member.

Despite having different wavelengths, the antenna formed in the first tubular structure and the antenna formed in the second tubular structure share a same structure and a same operation principle. For example, in response to N number of antennas included in the electronic device, the electronic device may include N number of tubular structures, each having the annular cross-section. The tubular structures share the same structure. By adjusting a position of the insulating slot in the tubular structures and a position of the first feed point and/or the first grounding point relative to the insulating slot, the resonant frequency of each of the antennas in the tubular structures may be adjusted. As such, the different tubular structures may receive the antenna signals of different wavelengths. N is an integer greater than 1.

In one embodiment, in response to the two antennas included in the electronic device, the electronic device further includes an auxiliary tubular member disposed on a side of the first tubular member 10 facing away from the second tubular member 20. The auxiliary tubular member and the first tubular member 10 are insulated by another insulating spacer. Another insulating slot is disposed on a sidewall of the auxiliary tubular member and extends through the entire sidewall in the direction that the first tubular structure extends. The auxiliary tubular member includes a third feed point and at least receives an antenna signal from the third feed point to transmit the antenna signal outwardly. Compared to only one antenna included in the electronic device, the electronic device includes the two antennas. Both antennas are coupled to the first tubular member 10 to further simplify the structure of the electronic device. However, the present disclosure does not limit to this configuration.

In one embodiment, at least a portion of the rotating shaft system is located inside the first tubular member 10 and does not extend into the auxiliary tubular member to avoid interference with the radiating performance of the auxiliary tubular member or degradation of the antenna performance of the electronic device.

For illustrative purposes, the electronic device having two tubular structures is described in the following embodiments. The two tubular structures are the first tubular structure and the second tubular structure. Because the two tubular structures share the same structure and the same operation principle, only differences between the electronic device having the two antennas and the electronic device having only one antenna are described. Similarities will not be repeated.

In one embodiment, the electronic device includes the two antennas, that is, the first tubular structure and the second tubular structure. At least a portion of the first rotating shaft structure is located inside the first tubular member 10 and does not extend into the second tubular member 20 to avoid interference with the radiating performance of the second tubular member or degradation of the antenna performance of the electronic device. At least a portion of the second rotating shaft structure is located inside the third tubular member and does not extend into the fourth tubular member to avoid interference with the radiating performance of the fourth tubular member or degradation of the antenna performance of the electronic device.

In one embodiment, the first rotating shaft structure is electrically connected to the first tubular member 10, such that the first rotating shaft structure becomes a part of the antenna structure of the electronic device, thereby reducing the degradation of the antenna performance of the electronic device caused by the first rotating shaft structure. Similarly, the second rotating shaft structure is electrically connected to the first tubular member 10, such that the second rotating shaft structure becomes a part of the antenna structure of the electronic device, thereby reducing the degradation of the antenna performance of the electronic device caused by the second rotating shaft structure.

In one embodiment, the electronic device may be a single-shaft electronic device. That is, the first body of the electronic device may rotate between 0° and 180° relative to the second body of the electronic device. In another embodiment, the electronic device may be a dual-shaft electronic device. That is, the first body of the electronic device may rotate between 0° and 360° relative to the second body of the electronic device. The present disclosure does not limit the number of rotating shafts in the electronic device.

In one embodiment, the electronic device is the single-shaft electronic device. That is, the rotating shaft system includes only one rotating shaft structure. As shown in FIG. 4, the first rotating shaft structure includes a first rotating shaft. The first fixing member is rotationally coupled to the first rotating shaft. The second fixing member is rotationally coupled to the first rotating shaft. Similarly, the second rotating shaft assembly includes a second rotating shaft. The third fixing member is rotationally coupled to the second rotating shaft. The fourth fixing member is rotationally coupled to the second rotating shaft. Thus, the first body may rotate relative to the second body. In one embodiment, the first rotating shaft and the second rotating shaft are disposed on a same straight line.

In one embodiment, the electronic device is the dual-shaft electronic device. That is, the rotating shaft system includes the two rotating shaft structures. As shown in FIG. 5, the first rotating shaft structure includes a third rotating shaft, a fourth rotating shaft, and a first rotating member that is rotationally coupled to the third rotating shaft and the fourth rotating shaft. The first fixing member is rotationally coupled to the third rotating shaft. The second fixing member is rotationally coupled to the fourth rotating shaft. Similarly, the second rotating shaft structure includes a fifth rotating shaft, a sixth rotating shaft, and a second rotating member that is rotationally coupled to the fifth rotating shaft and the sixth rotating shaft. The third fixing member is rotationally coupled to the fifth rotating shaft. The fourth fixing member is rotationally coupled to the sixth rotating shaft. Thus, the first body may rotate relative to the second body. In one embodiment, the third rotating shaft and the fifth rotating shaft are disposed on a same straight line, and the fourth rotating shaft and the sixth rotating shaft are disposed on a same straight line. The first rotating member and/or the second rotating member may be a hinge structure or a gear structure. The present disclosure does not limit structures of the first rotating member and the second rotating member.

In other embodiments, the rotating shaft system may include a plurality of rotating shafts. The present disclosure does not limit the number of the rotating shafts.

In the electronic device provided by the present disclosure, the antenna signal received from the first feed point may be transmitted outwardly through the second tubular member in the first tubular structure. That is, the second tubular member functions as the antenna radiator of the electronic device. As such, the limitation of configuring the antenna radiator only on the main board in the existing electronic device may be eliminated, and the problem of the limited antenna configurations in the existing electronic device may be resolved, thereby satisfying the demand for flexible antenna configurations in the electronic device.

Moreover, in the electronic device provided by the present disclosure, the casing of the rotating shaft system forms the antenna structure without the need for the separately fabricated antenna radiator. On the basis that the antenna of the electronic device achieves the desirable antenna performance, the cost of the electronic device is reduced, and the size of the electronic device does not increase, thereby catering to the development trend of the ultra-thin electronic devices. In response to the all-metal casing of the electronic device, the electronic device satisfies the requirements of the antenna performance without cutting any slot or slit on the casing of the electronic device. Thus, the appearance of the electronic device is more beautiful and the integrity of the appearance of the electronic device is preserved.

Moreover, in the electronic device provided by the present disclosure, the casing of the rotating shaft system forms the antenna radiator. The antenna radiator is formed in a position where the first body and the second body are connected. As such, the first body of the electronic device may rotate in any angle relative to the second body of the electronic device without degrading the antenna performance of the electronic device. Thus, the antenna performance of the electronic device remains substantially unaffected.

In addition, in the electronic device provided by the present disclosure, the first tubular structure is the metallic tubular structure. That is, the casing of the rotating shaft system of the electronic device is made of the metallic material. Thus, the metal proportion in the electronic device increases, the consistency of the overall appearance of the electronic device improves, and the electronic device appears more elegant.

It should be understood by those skilled in the art that, for convenience and brevity, the description of the embodiments is arranged in a progressive manner. Each embodiment is described with a focus on differences from other embodiments while reference is made for similarities between different embodiments.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. An electronic device, comprising:

a first body;

a second body;

a rotating shaft system connecting the first body and the second body, the first body being configured to rotate relative to the second body;

a first tubular structure having an annular cross-section comprising a conductive first tubular member at a first end of the first tubular structure and a conductive second tubular member at a second end of the first tubular structure;

an insulating spacer disposed between the first tubular member and the second tubular member;

an insulating slot disposed on a sidewall of the second tubular member and extending through the sidewall along a direction the first tubular structure extends; and a first feed point disposed on the second tubular member, the second tubular member transmitting a signal received from the first feed point;

wherein a portion of the rotating shaft system is located inside the first tubular member and does not extend into the second tubular member.

2. The electronic device according to claim 1, wherein:

the insulating spacer and the insulating slot are connected.

3. The electronic device according to claim 2, wherein:

the insulating spacer and the insulating slot are perpendicular to each other.

4. The electronic device according to claim 3, wherein:

the insulating spacer is filled with air; and the insulating slot is filled with air.

5. The electronic device according to claim 3, further comprising:

a first insulating member disposed in the insulating spacer; and a second insulating member disposed in the insulating slot.

6. The electronic device according to claim 1, wherein:

the second tubular member includes a first grounding point;

the electronic device further includes a second grounding point;

the first tubular member is electrically connected to the second grounding point; and the first grounding point is electrically connected to the second grounding point through the first tubular member.

7. The electronic device according to claim 1, wherein:

the rotating shaft system includes a first rotating shaft assembly and a second rotating shaft assembly;

the first rotating shaft assembly includes a first fixing member coupled to the first body, a second fixing member coupled to the second body, and a first rotating shaft structure rotationally coupled to the first fixing member and the second fixing member; and the second rotating shaft assembly includes a third fixing member coupled to the first body, a fourth fixing member coupled to the second body, and a second rotating shaft structure rotationally coupled to the third fixing member and the fourth fixing member.

8. The electronic device according to claim 7, wherein:

a portion of the first rotating shaft structure is located inside the first tubular member and does not extend into the second tubular member; or a portion of the second rotating shaft structure is located inside the first tubular member and does not extend into the second tubular member.

9. The electronic device according to claim 7, further comprising:

a second tubular structure having an annular cross-section and including a conductive third tubular member at a first end of the second tubular structure and a conductive fourth tubular member at a second end of the second tubular structure;

an insulating spacer disposed between the third tubular member and the fourth tubular member;

an insulating slot disposed on a sidewall of the fourth tubular member and extending through the sidewall along a direction that the second tubular structure extends; and a second feed point disposed on the fourth tubular member, the fourth tubular member transmitting a signal received from the second feed point.

10. The electronic device according to claim 9, wherein:

a portion of the first rotating shaft structure is located inside the first tubular member and does not extend into the second tubular member; and a portion of the second rotating shaft structure is located inside the third tubular member and does not extend into the fourth tubular member.

11. The electronic device according to claim 1, further comprising:

a second tubular structure having an annular cross-section and including a conductive third tubular member at a first end of the second tubular structure and a conductive fourth tubular member at a second end of the second tubular structure;

a second insulating spacer disposed between the third tubular member and the fourth tubular member;

a second insulating slot disposed on a sidewall of the fourth tubular member and extending through the sidewall along a direction that the second tubular structure extends; and a second feed point disposed on the fourth tubular member, the fourth tubular member transmitting a signal received from the second feed point.

12. The electronic device according to claim 11, wherein the first tubular structure and the second tubular structure are made of a metallic material.

13. The electronic device according to claim 11, wherein the fourth tubular member receives a signal at the second feed point.

* * * * *